US011668056B2

(12) United States Patent
Lin et al.

(10) Patent No.: US 11,668,056 B2
(45) Date of Patent: Jun. 6, 2023

(54) BURNER AND LOCOMOTIVE FOR SPREADING WATERPROOF COIL IN HOT MELT MANNER

(71) Applicant: BEIJING ORIENTAL YUHONG WATERPROOF TECHNOLOGY CO., LTD., Beijing (CN)

(72) Inventors: Haixia Lin, Beijing (CN); Xin Wang, Beijing (CN); Li Ma, Beijing (CN)

(73) Assignee: ORIENTAL YUHONG WATERPROOF TECHNOLOGY CO., LTD., Beijing (CN)

( * ) Notice: Subject to any disclaimer, the term of this patent is extended or adjusted under 35 U.S.C. 154(b) by 493 days.

(21) Appl. No.: 16/637,041

(22) PCT Filed: Aug. 3, 2018

(86) PCT No.: PCT/CN2018/098462

§ 371 (c)(1),
(2) Date: Feb. 6, 2020

(87) PCT Pub. No.: WO2019/029440

PCT Pub. Date: Feb. 14, 2019

(65) Prior Publication Data

US 2020/0240093 A1 Jul. 30, 2020

(30) Foreign Application Priority Data

Aug. 9, 2017 (CN) ..... 201710676101.4
Aug. 9, 2017 (CN) ..... 201710676124.5
(Continued)

(51) Int. Cl.
*E01C 23/06* (2006.01)
*E01C 19/00* (2006.01)
(Continued)

(52) U.S. Cl.
CPC ..... *E01C 23/06* (2013.01); *E01C 19/002* (2013.01); *F23D 14/02* (2013.01); *F23D 14/28* (2013.01); *F23D 14/34* (2013.01); *F23D 14/84* (2013.01)

(58) Field of Classification Search
CPC ..... E04D 15/06; F23D 14/02; F23D 14/28; F23D 14/34; F23D 14/36; F23D 14/58;
(Continued)

(56) References Cited

U.S. PATENT DOCUMENTS 422,278 A * 2/1890 Archer ..... A01M 15/00 37/227
2,500,583 A * 3/1950 Smith ..... E04D 15/06 156/577
(Continued)

FOREIGN PATENT DOCUMENTS

CN 1336317 A 2/2002
CN 2821016 Y 9/2006
(Continued)

*Primary Examiner* — Jorge A Pereiro
*Assistant Examiner* — Logan P Jones
(74) *Attorney, Agent, or Firm* — Browdy and Neimark, PLLC

(57) ABSTRACT

A locomotive (10) for spreading a waterproof coil in a hot melt manner. The locomotive (10) for spreading a waterproof coil in a hot melt manner comprises: a locomotive frame (11), provided with a coil support (12); and wheel devices, a spreading device, a combustion and heating device and a coil compaction device that are disposed on the locomotive frame (11). The combustion and heating device comprises a combustion chamber (6) and a mixing chamber (2). The mixing chamber (2) is provided with a fuel gas inlet end (5), an air inlet end (28), and an outlet end (29). The outlet end (29) is connected to the combustion chamber (6). Multiple gas discharge holes (7) are formed in one side surface of the combustion chamber (6) in an axial direction.
(Continued)

The locomotive (10) for spreading a waterproof coil in a hot melt manner improves the construction efficiency, reduces human power costs and reduces consumption of fuel gas.

13 Claims, 4 Drawing Sheets

(30) Foreign Application Priority Data

| | | |
|---|---|---|
| Aug. 9, 2017 | (CN) | 201710676128.3 |
| Aug. 9, 2017 | (CN) | 201710676702.5 |
| Aug. 9, 2017 | (CN) | 201710677237.7 |
| Aug. 9, 2017 | (CN) | 201710677238.1 |
| Aug. 9, 2017 | (CN) | 201710677239.6 |
| Aug. 9, 2017 | (CN) | 201720990677.3 |
| Aug. 9, 2017 | (CN) | 201720990724.4 |
| Aug. 9, 2017 | (CN) | 201720991307.1 |
| Aug. 9, 2017 | (CN) | 201720991853.5 |
| Aug. 9, 2017 | (CN) | 201720991872.8 |
| Aug. 9, 2017 | (CN) | 201720992992.X |
| Aug. 9, 2017 | (CN) | 201720995783.0 |
| May 21, 2018 | (CN) | 201810486804.5 |
| May 21, 2018 | (CN) | 201820752620.4 |

(51) Int. Cl.

| | |
|---|---|
| ***F23D 14/02*** | (2006.01) |
| ***F23D 14/28*** | (2006.01) |
| ***F23D 14/34*** | (2006.01) |
| ***F23D 14/84*** | (2006.01) |
| ***E01C 23/14*** | (2006.01) |
| ***F23D 14/58*** | (2006.01) |
| ***E01C 19/52*** | (2006.01) |
| ***E04D 15/06*** | (2006.01) |
| ***F23D 14/36*** | (2006.01) |
| ***F23D 99/00*** | (2010.01) |

(58) Field of Classification Search
CPC ..... F23D 14/84; F23D 2203/102; F23D 2900/21; F23D 91/02; E01C 23/14
See application file for complete search history.

(56) References Cited

U.S. PATENT DOCUMENTS

| | | | | | |
|---|---|---|---|---|---|
| 3,555,978 | A * | 1/1971 | McCool | B65H 33/04 | 270/58.32 |
| 3,902,666 | A * | 9/1975 | Ito | E01C 23/14 | 239/176 |
| 3,963,414 | A * | 6/1976 | Jensen | F24C 3/042 | 126/92 AC |
| 4,711,600 | A * | 12/1987 | Yates | E01C 23/14 | 126/271.2 A |
| 4,725,328 | A * | 2/1988 | Arnold | B29C 66/1122 | 156/308.2 |
| 2012/0244482 | A1 | 9/2012 | Homma | | |
| 2018/0217587 | A1 * | 8/2018 | Gates | B60L 58/10 | |

FOREIGN PATENT DOCUMENTS

| | | | | |
|---|---|---|---|---|
| CN | 101109210 | A | 1/2008 | |
| CN | 201163021 | Y | 12/2008 | |
| CN | 103147381 | A | 6/2013 | |
| CN | 103469159 | A | 12/2013 | |
| CN | 203489276 | U | 3/2014 | |
| CN | 205012205 | U | 2/2016 | |
| CN | 105892465 | A | 8/2016 | |
| CN | 205717194 | U | 11/2016 | |
| CN | 106743874 | A | 5/2017 | |
| CN | 107355050 | A | 11/2017 | |
| CN | 107355051 | A | 11/2017 | |
| CN | 107355784 | A | 11/2017 | |
| CN | 107366394 | A | 11/2017 | |
| CN | 107366395 | A | 11/2017 | |
| CN | 107366396 | A | 11/2017 | |
| CN | 107366908 | A | 11/2017 | |
| CN | 207091897 | U | 3/2018 | |
| CN | 207092409 | U | 3/2018 | |
| CN | 207228503 | U | 4/2018 | |
| DE | 525174 | C | 5/1931 | |
| DE | 4416452 | A1 * | 11/1995 | B29C 65/02 |
| EP | 2746658 | A1 | 6/2014 | |
| GB | 269698 | A | 4/1927 | |
| JP | H09222208 | A | 8/1997 | |
| KR | 20110018604 | A | 2/2011 | |
| WO | WO-2017159079 | A1 * | 9/2017 | B01D 53/86 |

* cited by examiner

BURNER AND LOCOMOTIVE FOR SPREADING WATERPROOF COIL IN HOT MELT MANNER

TECHNICAL FIELD

The present disclosure belongs to the field of waterproof construction engineering equipment, and more particularly, relates to a burner and a locomotive for spreading waterproof coil in hot melt manner.

BACKGROUND

Along with the continuous development and progress of China's economy, there are many major infrastructure projects in the country every year, including buildings, roads, bridges, tunnels, etc. In addition to the rapid growing of real estate projects, these projects all involve waterproof construction.

In the existing construction of waterproof coils, generally, the waterproof coils are fully heated and laid on the site where waterproofing is required, and then compacted by rollers. For common manual heating operations, a worker holds a torch and heats the coil for a certain period of time before laying. Due to the large width of the coil, the handheld torch needs to be reciprocated in the horizontal direction. The heating effect is uneven and a long time should be taken. If multiple torches are used for heating at the same time, at least two workers need to be responsible for heating at the same time, which increases man-hours and costs.

In addition, in some existing locomotive for spreading waterproof coil in hot melt manner, multiple spray guns are fixed on the shelf, and ignited to heat the coils. Although the labor cost is saved, the problem of uneven heating still exists and fuel consumption becomes larger which leads to a lot of waste.

Therefore, it is necessary to develop a combustion device and a locomotive for spreading waterproof coil in hot melt manner with uniform fire capacity, sufficient combustion, energy saving and emission reduction.

The information disclosed in the background section of the present disclosure is only intended to deepen the understanding of the general background of the present invention and should not be taken as an acknowledgement or any form of suggestion that the information constitutes prior art that is already known to those skilled in the art.

SUMMARY

The purpose of the present disclosure is to provide a burner and a locomotive for spreading waterproof coil in hot melt manner. The burner adopts a premixed method, which has sufficient fuel gas combustion, high heat energy utilization, and forms uniform and stable flame. By adopting this kind of combustion method, emissions of carbon monoxide and nitrogen oxide can be effectively reduced, the environment protection is achieved, and energy saving and emission reduction is realized. The locomotive for spreading waterproof coil in hot melt manner is capable of paving and compacting asphalt-based waterproof coils on a stable structural layer.

To achieve the above object, a burner is provided according to an aspect of the present disclosure. The burner comprising: a combustion chamber; a mixing chamber provided with a fuel gas inlet end, an air inlet end, and an outlet end, and the outlet end is connected to the combustion chamber; wherein, multiple gas discharge holes are formed in one side surface of the combustion chamber in an axial direction.

According to another aspect of the present disclosure, a locomotive for spreading waterproof coil in hot melt manner is provided. The locomotive for spreading waterproof coil in hot melt manner comprising: a locomotive frame provided with a coil support for supporting a waterproof coil; a compaction roller (also known as paving roller) hinged to the front end of the locomotive frame; a guide roller, which is arranged on the locomotive frame and is located between the coil support and the compaction roller, and the waterproof coil can be provided around the compaction roller via the guide roller; the said burner which is arranged at the bottom of the locomotive frame and is used for heating the coil; a driving wheel, which can drive the locomotive for spreading waterproof coil in hot melt manner to run and lay the waterproof coil on the ground.

The beneficial effects of the present disclosure are as follows:

1) The burner of the present disclosure adopts a new combustion method of premixed combustion through the setting of a mixing chamber, that is, fuel gas and air are completely mixed according to a required ratio before combustion, and then the combustion is performed in a special burner. Compared with traditional diffusion combustion, the advantages of premixed combustion are: small excess fuel gas coefficient, sufficient combustion, high hot wind temperature, low noise, and less pollutants such as CO and NOx;

2) In the present locomotive for spreading waterproof coil in hot melt manner, a waterproof coil is placed on a coil support. The waterproof coil is guided to the compaction roller by the guide roller, and the bottom surface of the waterproof coil is baked by the burner. The mechanized construction of the hot-melt, paving and compaction of the waterproof coils is achieved as the driving wheel rotates.

Other features and advantages of the present disclosure will be described in detail in the detailed description section below.

BRIEF DESCRIPTION OF THE DRAWINGS

The above and other objects, features, and advantages of the present disclosure will become more apparent by describing the exemplary embodiments of the present disclosure in more detail with reference to the accompanying drawings. In the exemplary embodiments of the present disclosure, the same reference numerals generally represent the same parts.

Figure 1:
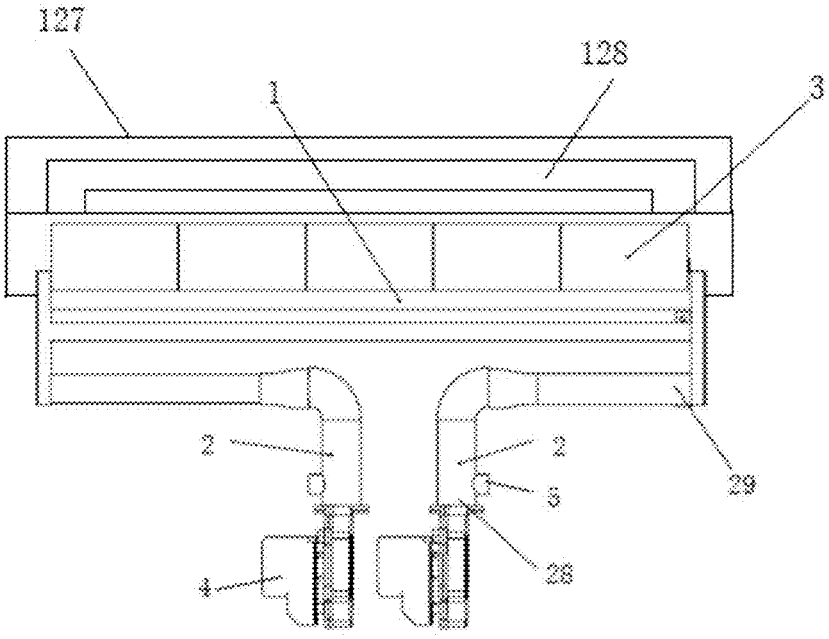
FIG. 1 is a schematic structural diagram of a burner according to an embodiment of the present disclosure.

Numbers in the accompanying drawings are described as follows:

101. flue gas recycling section; 102. recycling casing; 103. flue gas guide pipe; 104. flue gas recycling pipe; 105; draining fan; 106; drive motor; 107; constricted end. 1. burner; 2. mixing chamber; 3. fire shield; 4. fan; 5. fuel gas inlet end; 6. combustion chamber; 7. gas discharge holes; 28, air inlet end; 29, outlet end;

201, casing; 202, fuel gas inlet pipe; 203, oxidant gas inlet pipe; 204, regulating valve; 205, fuel gas mixing pipe; 206, oxidant gas mixing pipe; 207, partition; 208, unidirectional vent; 209, flow meter; 210, gas discharge pipe; 211, mixing fan; 212, mixing room; 213, gas storage room;

10. locomotive for spreading waterproof coil in hot melt manner; 11, locomotive frame; 12, coil support; 13, guide roller; 14, stopping roller; 15, driving wheel; 16, support wheel; 17, elastic scraper; 18, secondary compaction roller; 19, compaction roller; 20, hinge bracket; 8. spring; 9. control box; 121, first guiding device; 122, second guiding device; 123, reloading starting device; 124 storage box; 125, first photoelectric encoder; 126, second photoelectric encoder; 127, protection module; 128, concave-shaped heat exchanger;

21, compaction roller cylinder; 22, roller shaft; 23, joint bolt; 24, compaction spring; 26, linear bearing; 25, adjusting nut; 27, mounting bracket.

DETAILED DESCRIPTION OF THE EMBODIMENTS

Hereinafter, preferred embodiments of the present disclosure will be described in more detail. Although the preferred embodiments of the present disclosure are described below, it should be understood that the present disclosure can be implemented in various forms and should not be limited by the embodiments set forth herein. Rather, these embodiments are provided so that this invention will be more thorough and complete, and will fully convey the scope of the invention to those skilled in the art.

A burner is provided according to an aspect of the present disclosure. The burner comprising: a combustion chamber; a mixing chamber provided with a fuel gas inlet end, an air inlet end, and an outlet end, and the outlet end is connected to the combustion chamber; wherein, multiple gas discharge holes are formed in one side surface of the combustion chamber in an axial direction.

The present disclosure adopts a new type of combustion method of premixed combustion. Firstly, the fuel gas and air are completely mixed in the mixing chamber according to the required ratio, and then delivered to the combustion chamber for combustion. By adopting the premixed combustion method, small excess gas coefficient and sufficient combustion is achieved, high temperature of hot wind obtained, small noise, less pollutants generated such as CO and NOx are realized.

Optionally, the combustion chamber has a long cylindrical shape, for example, it may be a horizontal strip type, and its cross section may be circular, oval, square, rectangular, polygonal, or the like. The fire section thereof can be flat or curved. Because a plurality of air outlet holes are provided in the axial direction on the fire section, the burner of the present disclosure is more uniform in heating and saves fuel compared with that utilizes combined heating by multiple nozzles in the prior art.

As an optional implementation, the burner further comprises a fan, a driving device, a regulating valve, a fire shield, and a flame sensor; the fan is connected to the air inlet end of the mixing chamber, and is used for air blowing into the mixing chamber; the driving device is arranged at one end or both ends of the combustion chamber, and is used for driving the combustion chamber to rotate; the regulating valve is arranged at the fuel gas inlet end; the fire shield is located above the gas discharge holes; the flame sensor is arranged in the mixing chamber and is in communication connection with the regulating valve.

Specifically, the fan blows air into the mixing chamber, so that the air and the fuel gas are fully mixed in the mixing chamber. The pressure in the mixing chamber allows the mixed fuel gas to quickly enter the combustion chamber. After ignition, the flame is sprayed out from the gas discharge holes under pressure, forming a short and high-speed flame.

Optionally, one or both ends of the combustion chamber are provided with driving devices for driving the combustion chamber to rotate. For example, a rotation shaft is provided at one or both ends of the combustion chamber, and a driving motor is provided, so that the combustion chamber can rotate around the rotation shaft. By turning the combustion chamber, the orientation of the fire section of the combustion chamber can be adjusted, thereby a wider heating range is achieved. For example, when the ground needs to be heated, the fire section of the combustion chamber is turned toward the ground, and the flame is sprayed to the ground. The driving device can also be operated manually. By setting a rotation lever, the operator can manually rotate the combustion chamber to the desired position. A locking device may also be provided to fix the combustion chamber at a position with certain angular.

Optionally, the fire shield is located above the gas discharge holes. The fire section of the combustion chamber is normally facing forward or downward, in order to heat the coil in front or the laying surface below. The aim for setting the fire shield mainly prevents the flame from damaging other parts of the vehicle.

Optionally, the plurality of gas discharge holes are provided on the surface of the combustion chamber along the axial direction of the combustion chamber. The plurality of gas discharge holes may be arranged in an array, or staggered in adjacent rows or columns. Preferably, the plurality of gas discharge holes are uniformly arranged on the surface of the combustion chamber. Preferably, the shape of the gas discharge holes is rectangular, circular, or oval, etc.

Optionally, the flame detector can be a photocell detector, a photoresistor, a lead sulfide sensor, or a gallium phosphide sensor. When the flame detector detects that the high-frequency component is greater than 350 Hz, it sends an abnormal signal to the combustion control module which controls the electromagnetic valve to close, disconnects the gas supply, in order to perform inspection and repair.

Further, the plurality of gas discharge holes are provided on the surface of the combustion chamber along the axial direction of the combustion chamber. Optionally, the plurality of gas discharge holes may be arranged in an array, or staggered in adjacent rows or columns. Preferably, the plurality of gas discharge holes are uniformly arranged on the surface of the combustion chamber. More preferably, the axis of the gas discharge holes is inclined with respect to the surface of the combustion chamber. Optionally, the inclination directions of two adjacent gas discharge holes are different, and the gas discharge holes may have various inclination angles. By setting the gas discharge holes at an angle, the flame can be set in a cross form, which is beneficial to shorten the distance. Optionally, the axis of the gas discharge holes may have a plurality of inclined angles with respect to the surface of the combustion chamber.

Further, the pressure in the mixing chamber and the amount of air intake can be controlled by adjusting the rotation speed of the fan, thereby achieving a mixture of air and fuel gas in a proportion. Optionally, in order to measure the wind pressure blown by the fan, an air intake pipe is provided. The function of the air intake pipe is to measure the wind pressure of the wind blown by the fan, and the measured wind pressure is fed back to the proportional valve, and the amount of fuel gas is adjusted by the proportional valve according to the proportion to achieve the effect of proportional mixing, the air blown by the fan is mixed with the pressured fuel gas through a mixer. Moreover, the magnitude of the pressure in the mixing chamber is proportional to the firepower of the fire section. When it is necessary to increase the firepower, a larger flame can be obtained by increasing the fuel gas supply and increasing the fan speed, and the regulating valve is used to adjust the fuel gas supply. A mixture of air and fuel gas in the proportion can be achieved with adjusting the rotation speed of the fan.

Optionally, there are two mixing chambers, which are respectively connected to two ends of the combustion chamber. For example, each mixing chamber is provided with one fan to blow mixed fuel gas into the combustion chamber from both ends of the combustion chamber, which increases the amount of fuel gas in the combustion chamber, in order to increase heat quickly, improve heating efficiency and shorten construction time.

Optionally, the width of the fire section of the combustion chamber is consistent with the width of the coil. Alternatively, the width of the fire section of the combustion chamber can be adjusted so as to adapt to coils of different widths.

As an optional implementation, the flue gas recycling section includes a recycling casing, a flue gas guide pipe, a flue gas recycling pipe, and a draining fan. The recycling casing is arranged on the top of the combustion chamber and communicates with the combustion chamber. One end of the flue gas guide pipe communicates with the recycling casing, and the other end of the flue gas guide pipe communicates with the middle of the flue gas recycling pipe, and the draining fan is provided at the connection between the flue gas guide pipe and the flue gas recycling pipe.

As an optional implementation, the flue gas recycling section further comprises a drive motor, a catalyst support frame, and a three-way catalyst, and the drive motor is disposed on one side of the flue gas recycling pipe, an output shaft thereof is connected to the draining fan, the catalyst support frame is disposed on the other side of the flue gas recycling pipe, and the three-way catalyst is disposed on the catalyst support frame.

Specifically, the flue gas generated by the combustion of the fuel gas is recycled by the flue gas recycling section to prevent smoke and dust from blocking the user's sight and affecting the laying effect of the coil.

Optionally, the flue gas recycling section includes a recycling casing, a flue gas guide pipe, a flue gas recycling pipe, and a draining fan. The recycling casing is arranged on the top of the combustion chamber and communicates with the combustion chamber. One end of the flue gas guide pipe communicates with the recycling casing, and the other end of the flue gas guide pipe communicates with the middle of the flue gas recycling pipe, and the draining fan is provided at the connection between the flue gas guide pipe and the flue gas recycling pipe.

Specifically, the recycling casing is buckled on the top of the combustion chamber during use, and the wind generated by the draining fan rotates collects soot and dust through the recycling casing, and then flows into the flue gas recycling pipe through the flue gas guide pipe to prevent the smoke and dust from affecting the user's sight.

Specifically, a sealing device is installed on the side of the drive motor of the flue gas recycling pipe to allow the smoke and dust to pass through the catalyst support frame and the three-way catalyst in an orderly manner.

Specifically, the smoke and dust are collected by the wind of the draining fan, and then flowed through the catalyst support frame and the three-way catalyst through the flue gas recycling pipe. The smoke and dust are processed by the three-way catalyst, which is more environmentally friendly.

Specifically, the draining fan can be used to assist combustion and pool against flame of the burner.

Optionally, it further comprises a connection shaft and a heat insulation sleeve, the driving motor is connected to the draining fan through the connection shaft, and the heat insulation sleeve is sleeved on the connection shaft.

Specifically, the heat insulation sleeve is sleeved on the connecting shaft. The heat insulation sleeve can prevent the connecting shaft from being heat-aged and deformed without impeding the rotation of the connecting shaft.

Optionally, it further comprises a triangular fixing frame, and the heat insulation sleeve is connected to the flue gas recycling pipe through the triangular fixing frame.

Specifically, the heat insulation sleeve is fixed by the triangular fixing frame, which effectively reduces the contact points and promotes the flow of smoke and dust. At the same time, the heat insulation sleeve is fixed by the triangular fixing frame through three points, a better stabilization effect is achieved.

Optionally, the flue gas guide pipe includes a flared end and a constricted end, the constricted end of the flue gas guide pipe is communicated to the flue gas recycling pipe, and the flared end is communicated to the recycling casing.

Specifically, the effective area of flue gas collection of the flue gas guide pipe is increased through the setting of the flared end, which is convenient for sucking the flue gas through the draining fan, and the wind of the draining fan are collected through the setting of the constricted end, which is convenient for collecting dust. Optionally, there are two flue gas guide pipes, which are respectively communicated to the long side direction of the recycling casing, and there are two flue gas recycling pipes, which are respectively connected to the two flue gas guide pipes.

Specifically, the two flue gas guide pipes are respectively arranged at both ends of the recycling casing, thereby improving the collection efficiency of smoke and dust. Optionally, it further includes a smoke isolation plate, and the smoke isolation plate is disposed in the middle of the recycling casing.

Specifically, through the arrangement of the flue gas isolation plate, the two flue gas guide pipes are used to collect the flue gas at the two ends of the recycling casing without interfering with each other, which greatly improves the flue gas recycling rate and realizes the orderly discharge of smoke and dust.

Optionally, a plurality of gas discharge holes are arranged on the surface of the combustion chamber in an array form or a staggered form along the axial direction of the combustion chamber.

Specifically, the arrangement in the array form can make the flame more uniform, and the arrangement in the staggered form can make the flame spray forward different directions, so that the baking is more uniform.

Optionally, the mixed gas supply pipe includes a fuel gas inlet end, an air inlet end, and a fuel gas outlet end, and the fuel gas outlet end is connected to both sides of the combustion chamber.

Specifically, the air is supplied through the air inlet end, and the fuel gas is supplied through the fuel gas inlet end. The fuel gas and air are mixed in the mixed gas supply pipe and then discharged through the fuel gas outlet end, so that the fuel gas can be burned more fully.

As an optional implementation, the mixing chamber further comprises a fuel gas mixing pipe and an oxidant gas mixing pipe, and the fuel gas mixing pipe and the oxidant gas mixing pipe are disposed in the mixing chamber, the fuel gas mixing pipe communicates with the fuel gas inlet end, the oxidant gas mixing pipe communicates with the air inlet end, and the fuel gas mixing pipe and the oxidant gas mixing pipe are provided with through holes in an axial direction.

Specifically, the fuel gas enters the interior of the casing through the fuel gas inlet pipe and the fuel gas mixing pipe, and the oxidant gas enters the interior of the mixing chamber through the oxidant gas inlet pipe and the oxidant gas mixing pipe. The fuel gas and the oxidant gas are mixed in the casing of the mixing chamber. After mixing with the oxidant gas, the fuel gas can be fully burned, so that the maximum utilization of resources can be achieved.

Specifically, the fuel gas mixing pipe and the oxidant gas mixing pipe are evenly provided with through-holes, and the fuel gas enters the casing through the through-holes in the fuel gas mixing pipe, and the oxidant gas enters the casing through the through-holes in the oxidant gas mixing pipe, in order to make fuel gas and oxidant gas mix more fully. Specifically, one end of the fuel gas inlet pipe is communicated to the fuel gas tank, and one end of the oxidant gas inlet pipe may be communicated to the oxidant gas tank or to the air.

Optionally, a partition is provided inside the mixing chamber. The partition divides the mixing chamber into a mixing room and a gas storage room. The partition is provided with air outlet holes, the air outlet holes are unidirectional air outlet holes, and the middle of the air storage room is provided with a gas outlet pipe. Through the setting of the unidirectional air outlet holes, the mixed gas can only be transported to the gas storage room through the mixing room, preventing the backflow of the mixed gas, and making the use of gas mixer safer.

Optionally, flow meters are provided on the fuel gas inlet pipe and the oxidant gas inlet pipe, and the flow meter is used to detect the flowrate of the gas. The flowrate of the gas is detected through the setting of the flow meter, and the ratio of the fuel gas and the oxidant gas is rationalized, so that the combustion of the fuel gas is more sufficient.

Optionally, the mixing chamber further also includes a blender, and the blender is disposed in the mixing chamber. The blender is set to make the gas mix more fully. Optionally, the mixing chamber further includes a fan, and the fan is communicated to the air storage room through the gas supply pipe for blowing the mixed gas out through the air outlet pipe. By blowing the mixed gas out of the gas storage room through a fan, the gas supply speed of the fuel gas mixer can be greatly improved to meet a variety of requirements, resulting in short, high-speed flames.

Optionally, the fuel gas inlet pipe and the oxidant gas inlet pipe are provided with a regulating valve, and the regulating valve is used to regulate the supply amounts of the fuel gas and the oxidant gas.

According to another aspect of the present disclosure, a locomotive for spreading waterproof coil in hot melt manner is provided. The locomotive for spreading waterproof coil in hot melt manner comprising: a locomotive frame provided with a coil support for supporting a waterproof coil; a compaction roller hinged to the front end of the locomotive frame; a guide roller, which is arranged on the locomotive frame and is located between the coil support and the compaction roller, and the waterproof coil can be provided around the compaction roller via the guide roller;

said burner which is arranged at the bottom of the locomotive frame and is used for heating the coil;

a driving wheel, which can drive the locomotive for spreading waterproof coil in hot melt manner to run and lay the waterproof coil on the ground.

Specifically, the waterproof coil is placed on the coil support during use. The waterproof coil is guided to the compaction roller by the guide roller, and the bottom surface of the waterproof coil is dried by the burner. As the driving wheel rotates, the mechanized laying of the waterproof coil is realized. The present disclosure adopts a new type of combustion method of premixed combustion. Firstly, the fuel gas and air are completely mixed in the mixing chamber according to the required ratio, and then delivered to the combustion chamber for combustion. By adopting the premixed combustion method, small excess gas coefficient and sufficient combustion is achieved, high temperature of hot wind obtained, small noise, less pollutants generated such as CO and NOx are realized.

As an optional implementation, a compaction unit is also included. The compaction unit includes a pair of secondary compaction rollers and a scraper. The pair of secondary compaction rollers are disposed at both ends of the compaction roller, and are used to compact the edge portion of the coil. The scraper is arranged at one side of the pair of secondary compaction rollers away from the compaction roller.

Specifically, the edge portion of the waterproof coils needs to be particularly compacted to avoid curling or warping in the future. In addition, the part used to be overlapped needs to be particularly compacted. The molten asphalt in the coil is squeezed out and filled into the gap of the overlapped part, which makes the laying quality better. Specifically, a pair of secondary compaction rollers are disposed near both ends of the compaction rollers, and the secondary compaction rollers are pressed against the edge portion of the coil. Optionally, the length of the pair of secondary compaction rollers is shorter than the length of the compaction rollers. The secondary compaction rollers are disposed behind the compaction roller and are mainly used to compact the two edges of the coil. The elastic scraper is arranged behind the compaction roller, then the waterproof coil is compacted again by the scraper before it is compacted for the first time by the compaction roller, so that the coil and the laying surface are more tightly combined.

As an optional solution, the scraper is an elastic scraper, and a pressing plate of the elastic scraper comprise closely arranged comb-shaped teeth. The compaction roller includes a compaction roller cylinder, a roller shaft, and a pair of joint components. The compaction roller cylinder is installed on the roller shaft, and two ends of the roller shaft are mounted to two ends of the compaction roller through the joint components. Because the scraper is elastic, it can adapt to the undulating laying surface, and the effect is better than simply compacting with rigid rollers. In order to better adapt to various laying surfaces, the scraper is preferably arranged as closely arranged comb-shaped teeth. The width of each comb-shaped tooth is very small. The entire scraper is composed of a row of closely arranged comb-shaped teeth. In addition, each comb-shaped tooth is elastic and applies elastic force against the laying surface, so it can adapt to the various irregularities in the paving surface.

Further, the scraper includes a scraper mounting plate and a pressing plate, and the scraper is hinged to the front end of the hinge bracket through the scraper mounting plate. By using the scraper mounting plate to mount the pressing plate at the front end of the hinge bracket, the hinge bracket can apply a downward force on the scraper. By controlling the force applied by the hinge bracket, the bending of the elastic scraper can be controlled, combined with controlling the length of each comb-shaped tooth, the scraper can better adapt to various laying environments.

Further, a smooth tip is provided at the end of the comb-shaped tooth, which is more advantageous to protect the surface of the coil. For example, the tip may be a cylindrical pressing roller or a spherical pressing roller. The cylindrical pressing roller or the spherical pressing roller may be made of various materials, and may be made of steel or resin. The size of the cylindrical pressing roller or the spherical pressing roller can be set as required, depending on the size of the comb-shaped tooth. Optionally, a row of cylindrical pressing rollers or spherical pressing rollers can be closely arranged, and the elastic comb-shaped teeth can exert a force on the tip, which is more advantageous to protect the surface of the coil and suit for pressing in different base conditions.

Further, the width of the compaction roller and the scraper is equal to or greater than the width of the coil.

Further, the compaction roller may be a segmented compaction roller. The roller surface of the compaction roller is divided into multiple sections along the roller shaft which are discontinuous therebetween. Each section of the compaction roller can be moved laterally on the roller shaft to accommodate the intermediate undulating spreading surface.

Optionally, the joint assembly includes a joint bolt, an adjusting nut provided on the joint bolt, and a compaction spring. The compaction spring can be pressed by the adjusting nut to apply an elastic force to the compaction roller. Since the compaction spring is provided, the downward pressure of the compaction roller is increased.

Further, the compaction roller also includes a linear bearing provided between the adjusting nut and the compaction spring, so that when passing the uneven laying surface, the compaction roller can achieve a flexible adjustment space, better passability and compaction effect.

Optionally, the outer surface of the compaction roller is provided with a Teflon layer. The Teflon layer can ensure that the compaction roller does not stick to the asphalt, so as to ensure the cleanliness of the system. In addition, the Teflon material is resistant to high temperature and is not easy to fall off.

As an optional solution, the coil support comprises a first coil support and a second coil support for placing the coil; the locomotive for spreading waterproof coil in hot melt manner further comprises a first guiding device for tensioning and guiding the waterproof coil released from the first coil support under the compaction roller;

a second guiding device for tensioning and guiding the waterproof coil released from the second coil support under the compaction roller;

a reloading starting device which is electrically connected with the first guiding device or the second guiding device, and is used for starting the first guiding device or the second guiding device to convey the end of the waterproof coil under the compaction roller.

As an optional solution, a storage box is further included. The storage box is provided at the top between the first coil support and the second coil support. The bottom of the storage box is provided with a first opening and a second opening. The first opening faces the first coil support, and the second opening faces the second coil support.

Specifically, there are two coil supports, and the waterproof coils are placed on the coil supports to realize the automatic replacement of two waterproof coils. Optionally, it is also possible to include more coil supports for placing waterproof coils, so as to realize automatic reloading of more waterproof coils, the principle of which is the same as that of two waterproof coils.

One guiding device is provided for each coil. Specifically, a first guiding device is provided to tension and guide the waterproof coil released from the first coil support under the compaction roller, and a second guiding device is provided to tension and guide waterproof coil released from the second coil support under the compaction roller.

The guiding device can be implemented in various ways, for example, it can be a movable clamp or an adsorption roller, which clamps or sucks the end of the coil, and moves close to the compaction roller to tension and guide the waterproof coil under the compaction roller through a fixed moving track (for example, a sliding track or rotation track).

Optionally, the first guiding device or the second guiding device includes at least a pair of traction rollers, and the waterproof coil passes between the pair of traction rollers. Further, it further comprises a driving device for driving the pair of traction rollers to rotate relatively. The pair of traction rollers rotate relatively to cooperate with each other to convey the waterproof coil passing through.

Optionally, the position of the pair of traction rollers should be as close as possible to the compaction roller, so that the waterproof coil conveyed from the pair of traction rollers can easily contact the compaction roller, and the end of the coil is easy to reach under the compaction roller under the effect of gravity and the compaction roller.

Further, the reloading starting device includes a detection unit for detecting a used amount of the waterproof coil on the first guiding device or the second guiding device or whether the waterproof coil is used up. A plurality of detection means may be utilized in the detection unit. Preferably, detection units are respectively provided for the two coils.

For example, the detection unit may include two meter counters, which are respectively arranged on the transmission routes of the two waterproof coils, for detecting the usage of the waterproof coils, so that the remaining amount of the waterproof coils can be calculated. When the remaining length is equal to a present value, or setting a reminder for length in advance according to the known length of the waterproof coil, and when the value of the meter counter reaches the preset value, a signal is sent to the reloading starting device, and the pair of waiting traction rollers are started by the reloading starting device. The waterproof coil is conveyed under the compaction roller, so that two rolls of waterproof coil can be automatically overlapped without manual replacement in the downtime.

Optionally, the start-up time of the reloading starting device can be set according to the predetermined overlap size of the two rolls of waterproof coils, the start-up time of the reloading starting device can be calculated according to the remaining length of the coil, the paving speed of the compaction roller, the distance of the traction roller from the bottom of the compaction roller, and the rotation speed of the traction roller.

Optionally, the detection unit may be a pair of photoelectric switches, which are disposed at positions at the front end of the compaction roller where the waterproof coil passes, to detect whether the waterproof coil is used up. For example, a pair of photoelectric switches are disposed at a predetermined distance from the front end of the compaction roller, respectively above and below the waterproof coil. When the end of the waterproof coil passes the photoelectric switches, the photoelectric switches send signals to the reloading starting device to start the pair of waiting traction rollers to rotate to convey the waterproof coil under the compaction roller.

Optionally, the automatic coil replacing system of the present disclosure further comprises a storage box, and the storage box is disposed at an upper portion between the first coil support and the second coil support. By providing a storage box, the coils required for one construction can be placed in the storage box in advance, and there is no need to stop and load the coil during the construction process, so as to realize automatic coil replacement throughout the process, improve the construction efficiency and save labor costs.

Optionally, the storage box of the present disclosure can automatically supply coil to the coil support. For example, a first opening and a second opening are provided in the lower part of the storage box, the first opening faces the first coil support, and the second opening faces the second coil support. Further, the inside of the storage box is also divided into two parts, one part stores the waterproof coil used for the first coil support, and the other part stores the waterproof coil used for the second coil support. Storing the waterproof coils separately is advantageous to supplying coils to the first coil support and the second coil support respectively.

Further, a slideway is provided between the first opening and the first coil support, and a slideway is provided between the second opening and the second coil support, for conveying the waterproof coil to the coil support. After the opening is opened, the waterproof coil in the storage box can easily reach the coil support along the slideway.

Further, the locomotive further comprises an opening control device for opening and closing the first opening and the second opening. The opening control device can be electrically connected to the detection unit. When the detection unit detects that a certain waterproof coil is used up or only a predetermined length thereof is left, the detection unit sends a signal to the opening control device, and the opening control device will open the opening corresponding to the storage box. Therefore, the coil is conveyed to the coil support, thereby realizing continuous coil replacement without stopping the locomotive, so as to improve the construction efficiency.

As an optional solution, a control unit is further included. The compaction roller is hinged to the locomotive frame through a hinge bracket. The driving wheel includes a first driving wheel and a second driving wheel. The first driving wheel and the second driving wheel are symmetrically disposed on both sides of one end of the locomotive frame. A first driving motor is provided on the first drive wheel, and a second driving motor is provided on the second driving wheel. The control unit is in communication connection with the hinge bracket, the first driving motor, and the second driving motor.

As an optional solution, a first photoelectric encoder is provided on the first driving wheel, and a second photoelectric encoder is provided on the second driving wheel;

the control unit further comprises a correction module, which is in communication connection with the first photoelectric encoder and the second photoelectric encoder. After receiving the error signal, the correction module controls the first driving motor and/or the second driving motor to change the rotation speed to eliminate the error signal.

In one example, the first and second driving motors are stepper motors or servo motors.

Wherein, the stepper motor has strong anti-interference ability, and the changes in voltage, current and temperature have little effect on the stepper motor. The control speed of the stepper motor is fast, and the start and stop can be completed in a few pulses. The servo motor has higher accuracy and strong anti-overload capability, it can run smoothly at low speed, has a fast response to start and stop, and radiates low heat and low noise.

As an optional solution, a laying roller is hinged on the locomotive frame through a U-shaped hinge bracket and a hinge shaft. The hinge bracket can rotate on the hinge shaft. A third driving motor is provided at one end of the hinge shaft. A stopping module is provided on the hinge bracket. The control device also comprises a lifting control module. The lifting control module is electrically connected to the third driving motor of the hinge shaft. The hinge shaft is controlled to rotate upward, the hinge bracket touches the stopping module, and the stopping module sends a signal to the lifting control module. The lifting control module controls the hinge shaft to rotate downward and touches the ground.

In one example, the third driving motor may be a hydraulic motor or a stepper motor, which can realize low-speed rotation of the hinge shaft, and can also run smoothly when rotating at low speed.

In one example, the stopping module is a stop sensor or a stop switch. When the hinge bracket rotates upward and touches the stopping module, the signal of the stopping module is blocked and the hinge bracket rotates downward.

As an optional solution, the controller further includes a combustion control module, a flame angle control module, and a fire power adjustment module.

As an optional solution, the combustion control module is electrically connected with the ignitor, the regulating valve and the fan of the burner, and controls the regulating valve to be opened or closed according to the signal of the flame sensor; the flame angle control module is electrically connected with a fourth driving motor and controls the rotation angle of the rotating shaft to drive the combustion chamber to rotate according to the set angle of the flame angle control module; the fire power adjustment module is electrically connected to the fan to control the rotation speed of the combustion-supporting fan. When the walking module sends a signal, the combustion control module, the flame angle control module and the fire power adjustment module work at the same time, so that the flame angle and the flame size of the combustion unit can be adjusted.

In one example, the fourth driving motor may be a hydraulic motor or a stepper motor, which can achieve low-speed rotation of the hinge shaft, and can also run smoothly when rotating at low speed.

As an optional solution, an ultrasonic sensor is provided at the front end of the locomotive frame. The controller further includes a steering control module which is communicatively connected to the ultrasonic sensor, and controls the forward rotation, reverse rotation or stop, and power of the first driving motor or the second driving motor through signals from the ultrasonic sensor. The ultrasonic sensor sends a signal to the steering control module when it detects an obstacle in front, and the steering control module controls the steering of the locomotive for spreading waterproof coil in hot melt manner according to the position of the obstacle.

As an optional solution, a first photoelectric encoder is provided on the first driving wheel, and a second photoelectric encoder is provided on the second driving wheel. The controller further includes a correction module, which is in communication connection with the first photoelectric encoder and the second photoelectric encoder. After receiving the error signal, the correction module controls the first driving motor and/or the second driving motor to change the rotation speed to eliminate the error signal. The signals of the first photoelectric encoder and the second photoelectric encoder are sent to the correction module at the same time for signal comparison. After an error signal appears, the correction module controls the first driving motor and/or the second driving motor to change the rotation speed according to the error signal.

As an optional solution, a laser camera is provided on the coil support.

The correction module is communicatively connected with the laser camera. The laser camera takes photos of and analyzes the color marks on the coil, passes the analysis result to the correction module, and the correction module controls the first driving motor and/or the second driving motor to change the rotation speed to correct the walking trajectory.

A reference standard is set for the laser camera. The reference standard can be the ground, the wall, or the coils that have been laid. The color mark lines on the coils to be laid are compared with the reference standard for photographic analysis. If there is an error, the error information is transmitted to the correction module, and the correction module controls to change the rotation speed of the first driving motor and/or the second driving motor according to the error information to eliminate the error.

The locomotive for spreading waterproof coil in hot melt manner is intelligently controlled by the assembly of each module of the controller, thereby reducing the time of manual assistance, reducing the workload of the staff, the intelligent control achieves higher accuracy to improve the quality of waterproof construction.

As an optional solution, a self-balancing device is also included. The self-balancing device includes at least two pairs of shock-absorbing springs, a suspension frame, and ultrasonic sensors. The bottom end of said at least two pairs of shock-absorbing springs is connected to the locomotive frame, and the upper end thereof is connected to the suspension frame. The locomotive frame is disposed on the suspension frame, and the ultrasonic sensors are disposed on both sides of the suspension frame. By setting the shock-absorbing springs and the suspension frame on the locomotive frame, it is possible to absorb shock of the locomotive during walking and ensure the flatness and uniformity of the spreading of the modified asphalt. The front end and both sides of the frame are equipped with ultrasonic sensors, which can detect obstacles in the front and on both sides.

As an optional solution, a heat energy recycling module is also included. The heat energy recycling module includes a heat storage unit, a heat dissipation unit, and a heat transmission unit. The heat storage unit is buckled on the burner, and the heat storage unit is provided with a heat collection port to collect heat emitted from a shell of the burner. The heat dissipation unit is disposed on the heat storage unit and is connected to the heat storage unit. The heat transmission unit is disposed in the heat storage unit and sends out the heat in the heat storage unit from the heat radiation unit.

The heat energy recycling module collects the heat that cannot be fully utilized together, and then releases the collected heat to the place that needs to be heated through the heat transmission unit, so that the utilization of the energy released by the device is higher, thus saving energy and reducing cost.

The heat storage unit includes a rear wall opposite to the heat collecting port, an upper wall of the heat collecting port, a lower wall of the heat collecting port, and a pair of side walls on both sides of the heat collecting port. The upper wall of the heat collecting port is provided with an upper air outlet, and the lower wall of the mouth is provided with a lower air outlet.

In one example, the heat storage unit is a hollow cuboid, one side of which is opened as the heat collection port. But the shape of the heat storage unit is not limited to the hollow cuboid, and may be any hollow shape to achieve the purpose of the present disclosure.

Optionally, a pair of side walls is longer than the heat collecting port, and a pair of inner clips are provided on the pair of side walls which is longer than the heat collecting port. More preferably, a lower clip is provided on the upper wall of the heat collecting port, and an upper clip is provided on the lower wall of the heat collecting port. More preferably, the heat storage unit is provided outside the burner, avoiding the burner's nozzle, and is connected to the burner through the inner clips, the lower clip and the upper clip. A pair of side walls protrude to completely wrap the heat dissipation part of the burner, so as to realize a complete collection of heat, increase utilization of heat energy, and improve utilization of fuel gas in the burner.

The heat dissipation unit includes an upper heat dissipation unit and a lower heat dissipation unit. The upper heat dissipation unit is disposed at the upper air outlet, and the lower heat dissipation unit is disposed at the lower air outlet. The bi-directional heat dissipation unit can transfer the collected heat to multiple places where it is needed, improving the utilization of thermal energy.

In one example, the heat dissipation unit is a universal tube. The universal tube can be bent to any direction as required, so that the heat can be delivered to any place where it is needed.

Optionally, the connection angle between the upper heat dissipation unit and the upper air outlet is 30-150°, and the connection angle between the lower heat dissipation unit and the lower air outlet is 30-150°. There is a connection angle between the heat dissipation unit and the heat storage unit. According to the actual situation, the heat dissipation unit can be connected to the heat storage unit by a certain angle, so that the heat can be transmitted to any place needed.

Optionally, the heat transmission unit includes a pair of fans, the fan holders of the pair of fans are fixed on the rear wall, and the blowing ports of the pair of fans are aligned with the upper air outlet and the lower air outlet respectively. The fan is used as an auxiliary tool to accelerate the concentrated and rapid transfer of heat in the heat storage unit and improve the efficiency of heat employment.

The upper and lower air outlets are circular, oval, square, rectangular, or waist-shaped, and the shapes of the upper and lower air outlets match the shapes of the upper heat dissipation unit and the lower heat dissipation unit, respectively.

The locomotive collects the heat around the burner, and transfer the heat to the ground and/or the coil through the heat dissipation unit, so as to preheat the ground and the coil and improve the effect of waterproof coil spreading.

As an optional solution, a protection module is further included. The protection module includes an upper casing, a lower casing, a bracket, a heat insulation curtain, and a heat insulating coating. The upper casing and the lower casing are provided on the burner through the bracket, and the upper casing, the lower casing, and the bracket are filled with aluminum silicate paper. The heat insulation coating is applied on the surface of a shell of the burner, and the heat insulation curtain is arranged at the fire outlet of the burner.

Specifically, the protection module is buckled on the burner to insulate the burner to prevent overheating of the locomotive for spreading waterproof coil in hot melt manner.

As an optional solution, a concave-shaped heat exchanger is also provided, the concave-shaped heat exchanger is arranged between the upper casing and the burner, the concave-shaped heat exchanger comprising a honeycomb heat exchanger pipe and a draining fan, the inlet of the draining fan is provided in the middle of the concave-shaped heat exchanger, and the air outlet thereof is provided on both sides of the concave-shaped heat exchanger.

Specifically, the draining fan absorbs the heat from the top of the burner into the concave-shaped heat exchanger and discharges it through the air outlets on both sides of the concave-shaped heat exchanger.

Embodiment 1

Figure 2:
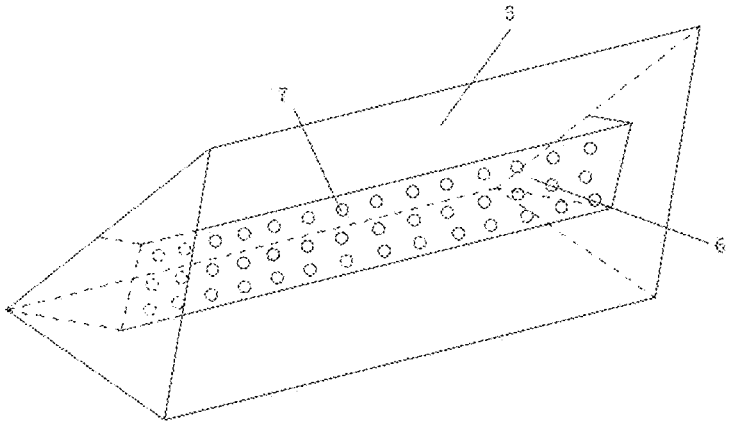
FIG. 2 is a schematic structural diagram of a burner according to an embodiment of the present disclosure.
Figure 3:
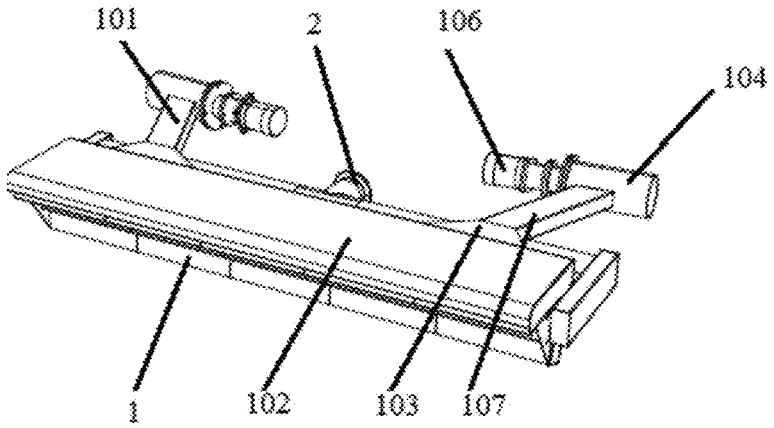
FIG. 3 shows a schematic diagram of the installation of the flue gas recycling section according to an embodiment of the present disclosure.
Figure 4:
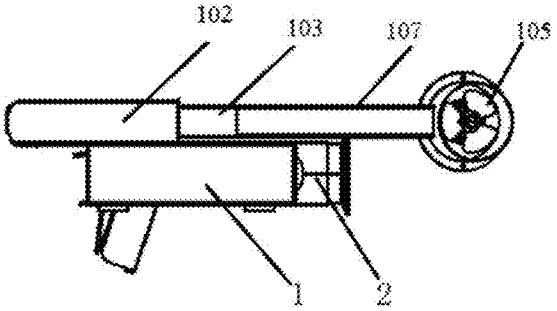
FIG. 4 shows a schematic structural diagram of a flue gas recycling section according to an embodiment of the present disclosure.

FIG. 1 is a schematic structural diagram of a burner according to an embodiment of the present disclosure. FIG. 2 is a schematic structural diagram of a burner according to an embodiment of the present disclosure. FIG. 3 shows a schematic diagram of the installation of the flue gas recycling section according to an embodiment of the present disclosure. FIG. 4 shows a schematic structural diagram of a flue gas recycling section according to an embodiment of the present disclosure.

As shown in FIGS. 1-4, the burner 1 of this embodiment comprises: a combustion chamber 6, the shape of the combustion chamber 6 is a long strip; two mixing chambers 2, each of which is provided with a fuel gas inlet end 5, an air inlet end 28 and an outlet end 29, the fan 4 is connected to the air inlet end 28 of the mixing chamber 2, and the outlet end 29 of each mixing chamber 2 is connected to one end of the combustion chamber 6.

A plurality of gas discharge holes 7 are provided along the axial direction on the fire section of the combustion chamber 6. The gas discharge holes 7 are arranged in an array along the axial direction of the combustion chamber 6. In this embodiment, the gas discharge hole 7 is circular, and the axis of the gas discharge hole 7 is inclined with respect to the surface of the combustion chamber 6, and the inclination directions of two adjacent gas discharge holes 7 are different, a fire shield 3 is located above the gas discharge holes 7.

A flue gas recycling section is sleeved outside the combustion chamber 6. Wherein, the flue gas recycling section 101 includes a recycling casing 102, a flue gas guide pipe 103, a flue gas recycling pipe 104, a draining fan 105, a drive motor 106, a catalyst support frame (not shown), and a three-way catalyst (not shown). The recycling casing 102 is disposed on the top of the combustion chamber 1 and communicates with the combustion chamber 1. One end of the flue gas guide pipe 103 communicates with the recycling casing 102, and the other end of the flue gas guide pipe communicates with the middle of the flue gas recycling pipe 104. The draining fan 105 is arranged at the communication point between the flue gas guide pipe 103 and the flue gas recycling pipe 104, the drive motor 106 is arranged on one side of the flue gas recycling pipe 104, the output shaft (not shown) is connected to the draining fan 105, and the catalyst support frame is disposed on the other side of the flue gas recycling pipe 104, and the three-way catalyst is disposed on the catalyst support frame. The flue gas guide pipe 103 includes a flared end and a constricted end 107, the constricted end 107 of the flue gas guide pipe 103 is communicated to the flue gas recycling pipe 104, and the flared end is communicated to the recycling casing 102.

Refer to FIG. 1, in this embodiment, a protection module 127 is further included. The protection module 127 includes an upper casing, a lower casing, a bracket, a heat insulation curtain, and a heat insulating coating. The upper casing and the lower casing are provided on the burner through the bracket, and the upper casing, the lower casing, and the bracket are filled with aluminum silicate paper. The heat insulation coating is applied on the surface of a shell of the burner, and the heat insulation curtain is arranged at the fire outlet of the burner.

Specifically, the protection module 127 is buckled on the burner to insulate the burner to prevent overheating of the locomotive for spreading waterproof coil in hot melt manner.

A concave-shaped heat exchanger 128 is also provided, the concave-shaped heat exchanger 128 is arranged between the upper casing and the burner, the concave-shaped heat exchanger 128 comprising a honeycomb heat exchanger pipe and a draining fan, the inlet of the draining fan is provided in the middle of the concave-shaped heat exchanger 128, and the air outlet thereof is provided on both sides of the concave-shaped heat exchanger 128.

In this embodiment, the combustion power of the burner is 105 kw, and the gas consumption per hour is 2 kg. The burner has a one-meter wide fire section, which is equivalent to the width of commonly used coils. The fire volume is uniform, the fuel gas is fully burned, the flame is blue-violet, and the heating efficiency is high. Compared with manual heating, the burner of the present disclosure has higher heating efficiency, and can heat 5 meters of coils per minute, while manual construction can only heat 0.6 meters of coils per minute. In addition, the burner of the present disclosure saves fuel gas, and the fuel gas required to heat per square meter coil is 0.02 kg, while for manual construction, the fuel gas required to heat the coil per square meter is 0.15 kg.

In addition, the burner of the present disclosure has a wider fire section, and the fire distributes uniformly on the entire fire section. The entire width of the coil can be heated at the same time, the heating effect is uniform, and the heating efficiency is greatly improved. Moreover, the fuel gas is fully burned to emit less pollutant which is environment friendly.

Embodiment 2

Figure 5:
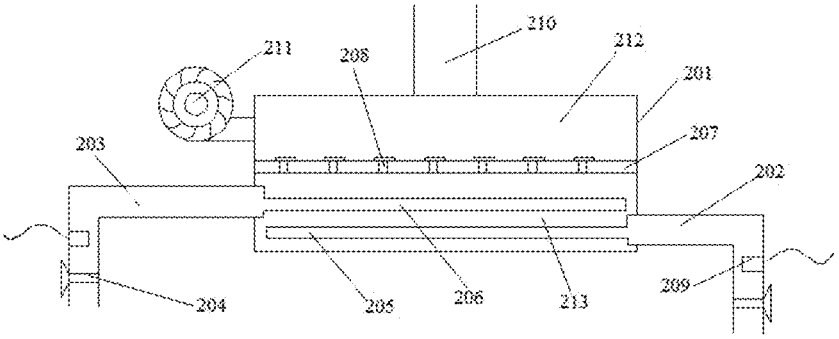
FIG. 5 is a schematic structural diagram of a mixing chamber according to another embodiment of the present disclosure.
Figure 6:
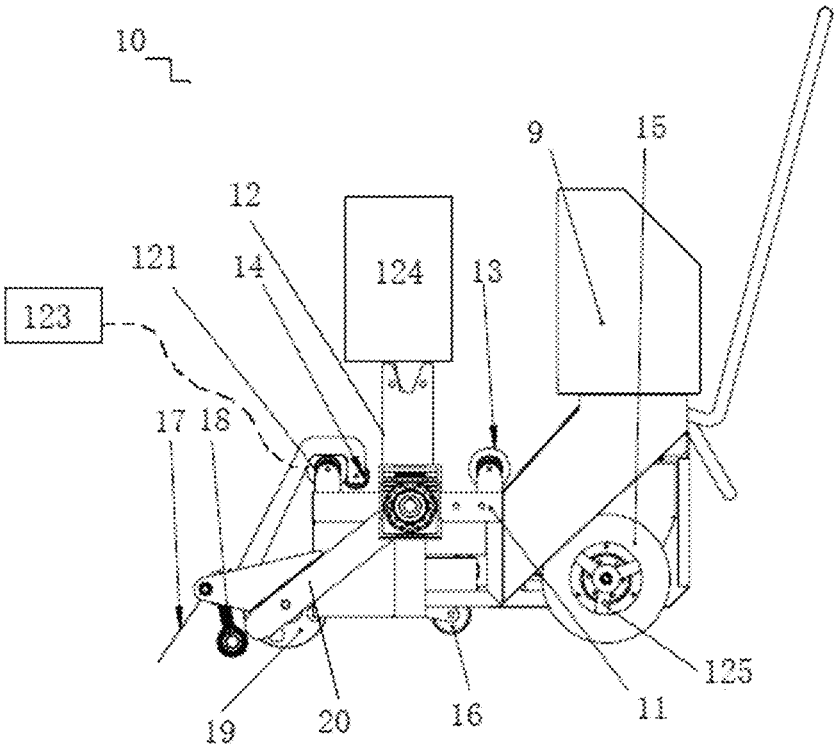
FIG. 6 is a schematic structural diagram of a locomotive for spreading waterproof coil in hot melt manner according to another embodiment of the present disclosure.
Figure 7:
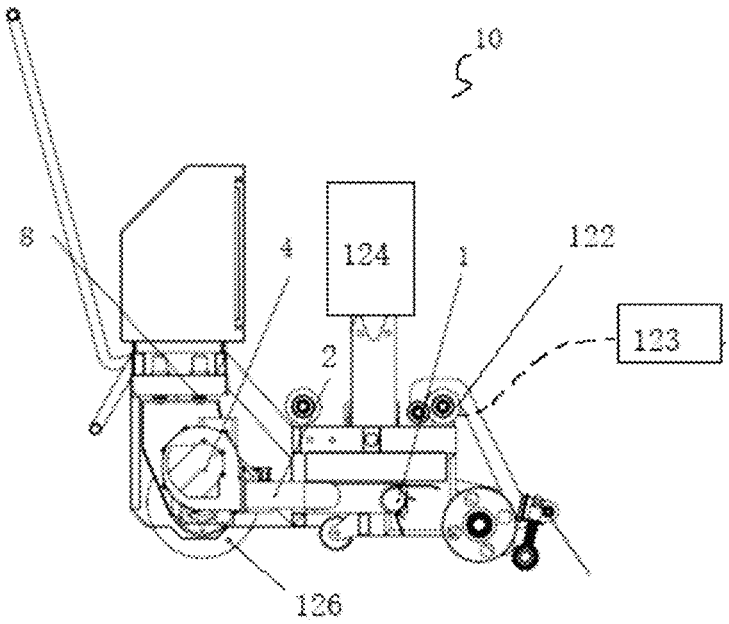
FIG. 7 is a schematic structural view of a locomotive for spreading waterproof coil in hot melt manner according to another embodiment of the present disclosure, and is a relative side view shown in FIG. 6.
Figure 8:
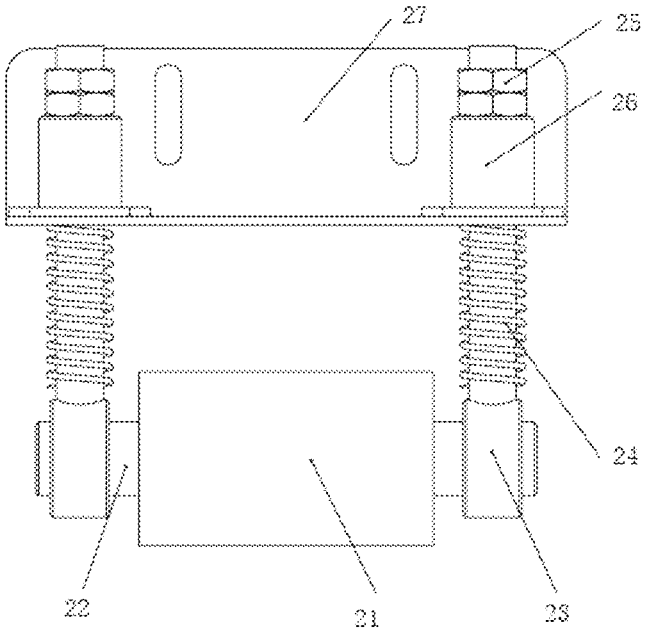
FIG. 8 is a schematic structural view of a compaction roller according to another embodiment of the present disclosure.

FIG. 5 is a schematic structural diagram of a mixing chamber according to another embodiment of the present disclosure. FIG. 6 is a schematic structural diagram of a locomotive for spreading waterproof coil in hot melt manner according to another embodiment of the present disclosure. FIG. 7 is a schematic structural view of a locomotive for spreading waterproof coil in hot melt manner according to another embodiment of the present disclosure, and is a relative side view shown in FIG. 6. FIG. 8 is a schematic structural view of a compaction roller according to another embodiment of the present disclosure.

As shown in FIG. 5 to FIG. 8, the locomotive for spreading waterproof coil in hot melt manner 10 in this embodiment includes: the locomotive frame 11, the middle of the locomotive frame 11 is provided with a coil support 12; driving wheels 15 and support wheels 16 provided on the locomotive frame 11; the paving device provided on the locomotive frame 11 includes a compaction roller 19, a guide roller 13, and a pair of stopping rollers 14, the compaction roller 19 is connected to the hinge bracket 20 through a compaction roller shaft, the pair of stopping rollers 14 are provided between the compaction roller 19 and the coil support 12, the waterproof coil passes the guide roller 13 and then passes through the stopping roller 14, and finally passes under the compaction roller 19; the coil compaction device provided on the locomotive frame 11 includes: a compaction roller 19 provided on a mounting bracket 27, the mounting bracket 27 is provided on the hinge bracket 20; a secondary compaction roller 18 is provided behind the compaction roller 19 and mounted on the mounting bracket 27; an elastic scraper 17, located behind the compaction roller 19, is mounted on the mounting bracket 27. As shown in FIG. 8, the secondary compaction roller 18 includes a compaction roller cylinder 21, a roller shaft 22, and a pair of joint components; the compaction roller cylinder 21 is mounted on the roller shaft 22, and both ends of the roller shaft 22 are mounted to the mounting bracket 27 through the joint component; the joint component includes a joint bolt 23, an adjusting nut 25 provided on the joint bolt 23, a compaction spring 24, and a linear bearing 26 provided between the adjustment nut 25 and the compaction spring 24; the compaction spring 24 can be pressed by the adjusting nut 25 to apply an elastic force to the compaction roller cylinder 21.

As shown in FIGS. 1-4, the combustion heating device provided on the locomotive frame 11 includes: the combustion chamber 6 and the mixing chamber 2, the mixing chamber 2 are provided with a fuel gas inlet end, an air inlet end 28, and an outlet end 29, and the outlet end 29 is connected to the combustion chamber 6; the shape of the combustion chamber 6 is a long strip; there are two mixing chambers 2 in this embodiment, each of the mixing chamber 2 is provided with a fuel gas inlet end 5, an air inlet end 28, and an outlet end 29. The fan 4 is connected to the air inlet end 28 of the mixing cavity 2. The outlet end 29 of every mixing cavity 2 is connected to one end of the combustion chamber 6; a fire shield 3 is provided above the combustion chamber 6.

Wherein, the mixing chamber 2 includes: a casing 201; a fuel gas inlet pipe 202 and an oxidant gas inlet pipe 203, and the fuel gas inlet pipe 202 and the oxidant gas inlet pipe 203 communicate with both sides of the casing 201 respectively; a regulating valve 204 which is arranged on the fuel gas inlet pipe 202 and the oxidant gas inlet pipe 203; a fuel gas mixture pipe 205 and an oxidant gas mixture pipe 206 arranged in the casing 201, the fuel gas mixing pipe 205 communicates with the fuel gas inlet pipe 202, the oxidant gas mixing pipe 206 communicates with the oxidant gas inlet pipe 203, and the fuel gas mixing pipe 205 and the oxidant gas mixing pipe 206 are provided with through holes (not shown) in the axial direction. A partition 207 is provided inside the casing 201, the partition divides the casing into a mixing room 212 and an air storage room 213. Air outlets are provided on the partition 207. The fuel gas inlet pipe 202 and the oxidant gas inlet pipe 203 are provided with a flow meter 209, and the flow meter 209 is used to detect the flowrate of the gas. A gas discharge pipe 210 is provided in the middle of the gas storage room 213. The mixing fan 211 is connected to the air storage room 213 through a gas supply pipe (not shown), and is used to blow out the mixed gas through the gas discharge pipe 210.

A plurality of gas discharge holes 7 are provided along the axial direction on the fire section of the combustion chamber 6. The gas discharge holes 7 are arranged in an array along the axial direction of the combustion chamber 6. In this embodiment, the gas discharge hole 7 is circular, and the axis of the gas discharge hole 7 is inclined with respect to the surface of the combustion chamber 6, and the inclination directions of two adjacent gas discharge holes 7 are different.

In this embodiment, the locomotive for spreading waterproof coil in hot melt manner is further provided with a control box 9 including a control panel, and the control panel is provided with control keys (not shown in the figure) that control various devices. In order to prevent the control box 9 from being affected by the vibration of the locomotive body, a shock-absorbing spring 8 is provided between the control box 9 and the locomotive frame 11.

In this embodiment, the combustion power of the burner is 105 kw, and the gas consumption per hour is 2 kg. The burner has a one-meter wide fire section, which is equivalent to the width of commonly used coils. The fire volume is uniform, the fuel gas is fully burned, the flame is blue-violet, and the heating efficiency is high.

Refer to FIG. 6 and FIG. 7, the coil support 12 comprises a first coil support and a second coil support for placing the coil; the locomotive for spreading waterproof coil in hot melt manner further comprises a first guiding device 121 for tensioning and guiding the waterproof coil released from the first coil support under the compaction roller 18, a second guiding device 122 for tensioning and guiding the waterproof coil released from the second coil support under the compaction roller 18; and a reloading starting device 123 which is electrically connected with the first guiding device 121 or the second guiding device 122, and is used for starting the first guiding device 121 or the second guiding device 122 to convey the end of the waterproof coil under the compaction roller 18.

Furthermore, a storage box 124 is further included. The storage box 124 is provided at the top between the first coil support and the second coil support. The bottom of the storage box 124 is provided with a first opening and a second opening. The first opening faces the first coil support, and the second opening faces the second coil support.

In this embodiment, a first photoelectric encoder 125 is provided on the first driving wheel, and a second photoelectric encoder 126 is provided on the second driving wheel. The control unit further comprises a correction module, which is in communication connection with the first photoelectric encoder 125 and the second photoelectric encoder 126. After receiving the error signal, the correction module controls the first driving motor and/or the second driving motor to change the rotation speed to eliminate the error signal.

Compared with manual heating, the burner of the present disclosure has higher heating efficiency, and can heat 5 meters of coils per minute, while manual construction can only heat 0.6 meters of coils per minute. In addition, the burner of the present disclosure saves fuel gas, and the fuel gas required to heat per square meter coil is 0.02 kg, while for manual construction, the fuel gas required to heat the coil per square meter is 0.15 kg.

In addition, the burner of the present disclosure has a wide fire section, and the fire distributes uniformly on the entire fire section. The entire width of the coil can be heated at the same time, the heating effect is uniform, and the heating efficiency is greatly improved. Moreover, the fuel gas is fully burned to emit less pollutant which is environment friendly.

Compared with the traditional manual construction, the locomotive for spreading waterproof coil in hot melt manner of the present disclosure has significant technical progress. For details, refer to the following table.

| | construction speed (m/min) | Fuel gas consumption (kg/m$^2$) | power consumption (kw*h/m$^2$) | construction time of single coil (min) | number of persons for construction (person) |
|---|---|---|---|---|---|
| locomotive | 5 | 0.02 | 0.06 | 3.5 | 2 |
| manual construction | 0.6 | 0.15 | 0 | 20.0 | 10 |
| efficiency comparison | 8 times | 13% | — | 17.5% | 1/5 |

It can be seen that the locomotive for spreading waterproof coil in hot melt manner of the present disclosure greatly improves the construction efficiency, and saves labor costs and fuel consumption.

The embodiments of the present disclosure have been described above, and the foregoing description is illustrative, but not limited, and is not limited to the disclosed embodiments. Many modifications and changes will be apparent to those skilled in the art without departing from the scope of the present disclosure.

The invention claimed is:

1. A locomotive for spreading waterproof coil in hot melt manner, the locomotive for spreading waterproof coil in hot melt manner comprising:

a locomotive frame provided with a coil support for supporting a waterproof coil;

a burner arranged at the bottom of the locomotive frame and is-used for heating the coil;

a compaction roller hinged to the front end of the locomotive frame;

a pair of secondary compaction rollers and a scraper, wherein the pair of secondary compaction rollers are disposed near the two ends of the compaction rollers to compact the edge portion of the coil, and the scraper is arranged at one side of the pair of secondary compaction rollers away from the compaction roller;

wherein the burner comprises:

a combustion chamber;

a mixing chamber provided with a fuel gas inlet end, an air inlet end, and an outlet end, and the outlet end is connected to the combustion chamber;

wherein multiple gas discharge holes are defined in one side surface of the combustion chamber in an axial direction.

2. The locomotive for spreading waterproof coil in hot melt manner according to claim 1, wherein the locomotive for spreading waterproof coil in hot melt manner further comprises:

a guide roller, which is arranged on the locomotive frame and is located between the coil support and the compaction roller, and the waterproof coil can be provided around the compaction roller via the guide roller;

a driving wheel, which can drive the locomotive for spreading waterproof coil in hot melt manner to run and lay the waterproof coil on the ground.

3. The locomotive for spreading waterproof coil in hot melt manner according to claim 1, wherein the scraper is an elastic scraper, and a pressing plate of the elastic scraper comprising closely arranged comb-shaped teeth, and the secondary compaction roller includes: a compaction roller cylinder, a roller shaft, and a pair of joint components; the compaction roller cylinder is installed on the roller shaft, and two ends of the roller shaft are mounted to two ends of the compaction roller through the joint components.

4. The locomotive for spreading waterproof coil in hot melt manner according to claim 1, wherein the coil support comprises a first coil support and a second coil support;

the locomotive for spreading waterproof coil in hot melt manner further includes:

a first guiding device for tensioning and guiding the waterproof coil released from the first coil support under the compaction roller;

a second guiding device for tensioning and guiding the waterproof coil released from the second coil support under the compaction roller;

a reloading starting device which is electrically connected with the first guiding device or the second guiding device, and is used for starting the first guiding device or the second guiding device to convey the end of the waterproof coil under the compaction roller.

5. The locomotive for spreading waterproof coil in hot melt manner according to claim 4, further comprising a storage box, the storage box is disposed at the top between the first coil support and the second coil support, the bottom of the storage box is provided with a first opening and a second opening, the first opening faces the first coil support, and the second opening faces the second coil support.

6. The locomotive for spreading waterproof coil in hot melt manner according to claim 2, further comprising a control unit, the compaction roller is hinged to the locomotive frame through a hinge bracket, and the driving wheel comprises a first driving wheel and a second driving wheel, the first driving wheel and the second driving wheel are symmetrically disposed on both sides of one end of the locomotive frame, the first driving wheel is provided with a first driving motor, the second driving motor is provided with a second driving motor, and the control unit is in communication connection with the hinge bracket, the first driving motor, and the second driving motor.

7. The locomotive for spreading waterproof coil in hot melt manner according to claim 6, wherein a first photoelectric encoder is provided on the first driving wheel, and a second photoelectric encoder is provided on the second driving wheel;

the control unit further comprises a correction module, the correction module is in communication connection with the first photoelectric encoder and the second photoelectric encoder, and after receiving an error signal, the correction module controls the first driving motor and/or the second driving motor to change the rotation speed to eliminate the error signal.

8. The locomotive for spreading waterproof coil in hot melt manner according to claim 1, further comprising a protection module, the protection module comprising an upper casing, a lower casing, a bracket, a heat insulation curtain and a heat insulation coating, the upper casing and the lower casing are provided on the burner through the bracket, and the upper casing, the lower casing, and the bracket are filled with aluminum silicate paper, the heat insulation coating is applied on the surface of a shell of the burner, and the heat insulation curtain is arranged at the fire outlet of the burner.

9. The locomotive for spreading waterproof coil in hot melt manner according to claim 8, further comprising a concave-shaped heat exchanger, the concave-shaped heat exchanger is provided between the upper casing and the burner, the concave-shaped heat exchanger comprising a honeycomb heat exchanger pipe and a draining fan, an air inlet of the draining fan is provided in the middle of the concave-shaped heat exchanger, and an air outlet thereof is provided on both sides of the concave-shaped heat exchanger.

10. The locomotive for spreading waterproof coil in hot melt manner according to claim 1, wherein the burner further comprises a fan, a driving device, a regulating valve, a fire shield, and a flame sensor;

wherein the fan is connected to the air inlet end of the mixing chamber, and is used for air blowing into the mixing chamber;

wherein the driving device is arranged at one end or both ends of the combustion chamber, and is used for driving the combustion chamber to rotate;

wherein the regulating valve is arranged at the fuel gas inlet end;

wherein the fire shield is located above the gas discharge holes; and wherein the flame sensor is arranged in the mixing chamber and is in communication connection with the regulating valve.

11. The locomotive for spreading waterproof coil in hot melt manner according to claim 1, wherein the burner further comprises a flue gas recycling section, the flue gas recycling section communicates with the combustion chamber, and the flue gas recycling section includes a recycling casing, a flue gas guide pipe, a flue gas recycling pipe, and a draining fan;

wherein the recycling casing is arranged on the top of the combustion chamber and communicates with the combustion chamber;

wherein one end of the flue gas guide pipe communicates with the recycling casing, and the other end of the flue gas guide pipe communicates with the middle of the flue gas recycling pipe; and wherein the draining fan is provided at a connection between the flue gas guide pipe and the flue gas recycling pipe.

12. The locomotive for spreading waterproof coil in hot melt manner according to claim 11, wherein the flue gas recycling section further comprises a drive motor, the drive motor is disposed on one side of the flue gas recycling pipe, an output shaft thereof is connected to the draining fan.

13. The locomotive for spreading waterproof coil in hot melt manner according to claim 1, wherein the mixing chamber further comprises a fuel gas mixing pipe and an oxidant gas mixing pipe, and the fuel gas mixing pipe and the oxidant gas mixing pipe are disposed in the mixing chamber, the fuel gas mixing pipe communicates with the fuel gas inlet end, the oxidant gas mixing pipe communicates with the air inlet end, and the fuel gas mixing pipe and the oxidant gas mixing pipe are provided with through holes in an axial direction.

* * * * *